United States Patent [19]

Doane et al.

[11] Patent Number: 4,527,662

[45] Date of Patent: Jul. 9, 1985

[54] ELEVATOR SPEED CONTROL

[75] Inventors: John C. Doane, Glastonbury; Clement A. Skalski, Avon, both of Conn.

[73] Assignee: Otis Elevator Company, Farmington, Conn.

[21] Appl. No.: 481,182

[22] Filed: Apr. 1, 1983

[51] Int. Cl.[3] ..... B66B 1/30

[52] U.S. Cl. ..... 187/29 R

[58] Field of Search ..... 187/29, 29 R

[56] References Cited

U.S. PATENT DOCUMENTS

| | | | |
|---|---|---|---|
| 3,589,474 | 6/1971 | Wavre | 187/29 R |
| 3,747,710 | 7/1973 | Winkler | 187/29 R |
| 3,777,855 | 12/1973 | Boyldew et al. | 187/29 R |
| 3,779,346 | 12/1973 | Winkler | 187/29 R |
| 3,783,974 | 1/1974 | Gilbert et al. | 187/29 R |

*Primary Examiner*—William M. Shoop
*Assistant Examiner*—Paul Shik Leun Ip
*Attorney, Agent, or Firm*—Robert E. Greenstien

[57] ABSTRACT

To control an elevator motor, a first analog signal, the profile of which defines the velocity characteristics during acceleration, is generated in response to a motor jerk signal, a signal to accelerate the motor. This first analog signal is then multiplied with a second analog signal to provide a third analog signal which is supplied to the motor controls. The magnitude and polarity of that third analog signal controls motor speed and direction. The second analog signal has a unity value, a value of one, except when the car is within a slowdown distance from the floor. When the car moves through that range, the second analog signal decreases from unity. The second analog signal is provided from digital coefficients that are stored in a memory device and addressable for particular positions from the slowdown position. The coefficients are addressed by the output from a down counter that counts pulses that are provided by a car position transducer as the car moves from the slowdown position. The relationship between the counts and the stored digital coefficients which they address define the deceleration profile.

3 Claims, 2 Drawing Figures

ELEVATOR SPEED CONTROL

DESCRIPTION

1. Technical Field

This invention is concerned with controlling the velocity of an elevator car.

2. Background Art

In the usual elevator, car speed is controlled by providing a control signal to the motor control and varying that signal to obtain acceptable acceleration, deceleration and velocity.

A closed-loop elevator control or servo loop gives accurate control of elevator speed, but because it relies on feedback, loop stability characteristics (e.g. velocity signal vaciations) sometimes diminish performance, and this is especially true in what are characterized as "sensitive" systems, those that have high loop gain. In these, during a short run (a run between adjacent floors when the car does not reach maximum speed before deceleration) it can be difficult to maintain low jerk rates in switching from high speed, accelerating to high speed, decelerating. In servo-loop systems, and especially the sensitive ones, the dictated velocity speed signals that control motor speed, acceleration and deceleration need to be very precise, and, perhaps most important of all, relatively free of transient components. Otherwise, high jerk rates may be present.

The prior art abounds with techniques to provide high quality speed signals in an elevator to provide precise, smooth control on all runs. One, the "analog" technique, provides speed signals for acceleration and deceleration continuously by integration and differentiation. Unfortunately, this scheme typically suffers inaccuracies, mostly from static and dynamic system variables, temperature drift component tolerances and power supply variations, just to name a few.

A different prior art approach relies on digital processing to provide speed signals that control motor operation. Using perhaps an iterative computation for each car position based on certain criteria, a digital process can accommodate system variables to alleviate many of the drift problems inherent in the analog speed dictation. But, total digital speed dictation is generally very expensive.

DISCLOSURE OF INVENTION

According to the invention, elevator car velocity is controlled in a new manner. The car is accelerated from zero velocity to run velocity when leaving a floor by providing a first signal from an analog circuit. In the process, this first signal is integrated to provide a second signal, and this second signal is integrated to provide a third signal that represents an instantaneous car velocity (car speed and direction).

This velocity signal is then scaled to provide a fourth signal whose magnitude controls the car velocity. Car position is sensed by a transducer that produces a signal (e.g., sequential pulses) that represent the speed and direction of the motor. When the car reaches a slowdown distance from the floor, a position counter begins counting down in response to that signal. The downcount output from this counter is an address, and this address is applied to a memory that contains various coefficients, each associated with a specific address. The coefficient (on the output from the memory) is converted to an analog signal, and this analog signal and the velocity speed (the third signal generated by analog integration) are multiplied. The product is the fourth signal. Except when the car reaches the slowdown point, the coefficient is unity, and, until that point, velocity control is analog, but, after that, a progressive, smooth, digitally-based blend of analog and digital, giving rise to smooth velocity curve, especially on a short run, and precise floor leveling.

BEST MODE FOR CARRYING OUT THE INVENTION

Figure 1:
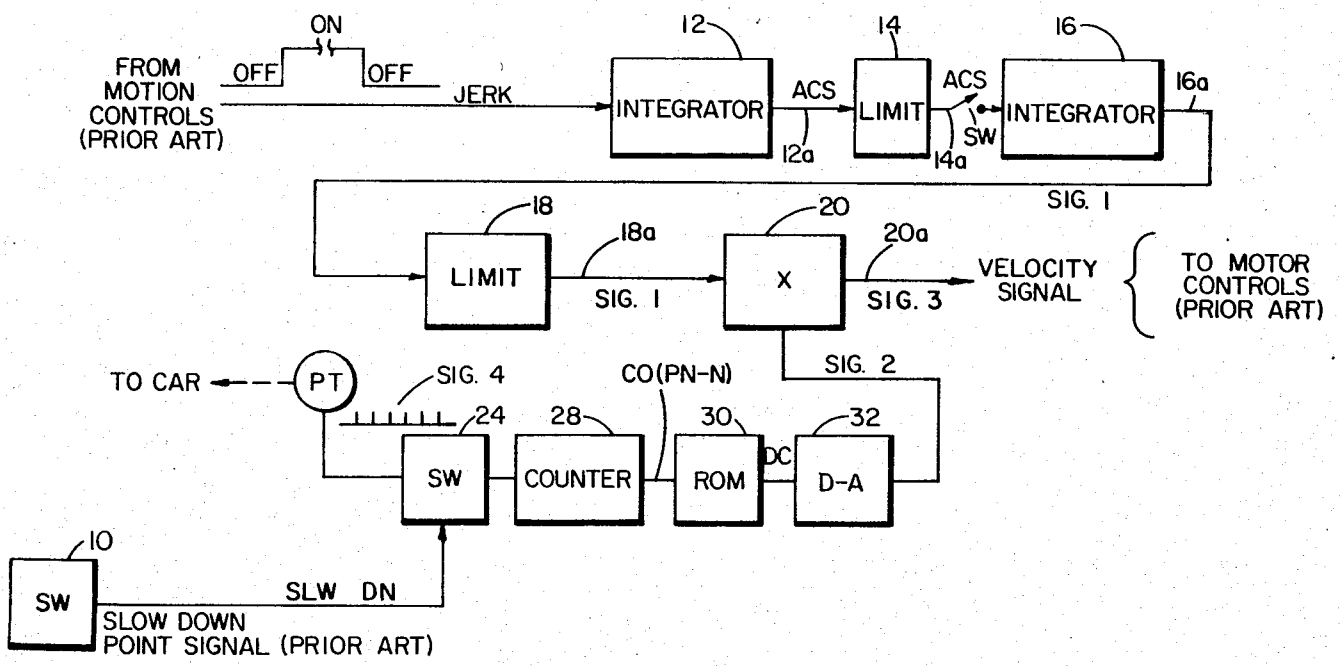
FIG. 1, a block diagram, shows a speed pattern generator according to the invention.

FIG. 1 shows, in block form, a speed or velocity signal generator embodying the present invention, but does not show various other prior art parts of a traditional elevator system, such as the motor control. They, and speed pattern generator applications, are extremely well known, which the numerous prior art elevator patents with speed pattern or deceleration equipment amply demonstrate.

In FIG. 1, two signals are received from a prior art elevator control, and the motor on/off signal or JERK signal (from the motion controls), and the other slowdown signal, SLW-DN, from a switch 10, which is actually nothing more than a sensing device that is located away from the floor over which the car slows down at some preset distance. The system that is shown in FIG. 1 uses those two signals to produce an analog VELOCITY SIGNAL, which is supplied to the prior art motor controls, and the magnitude and polarity of the VELOCITY SIGNAL determines motor speed and direction.

Figure 2:
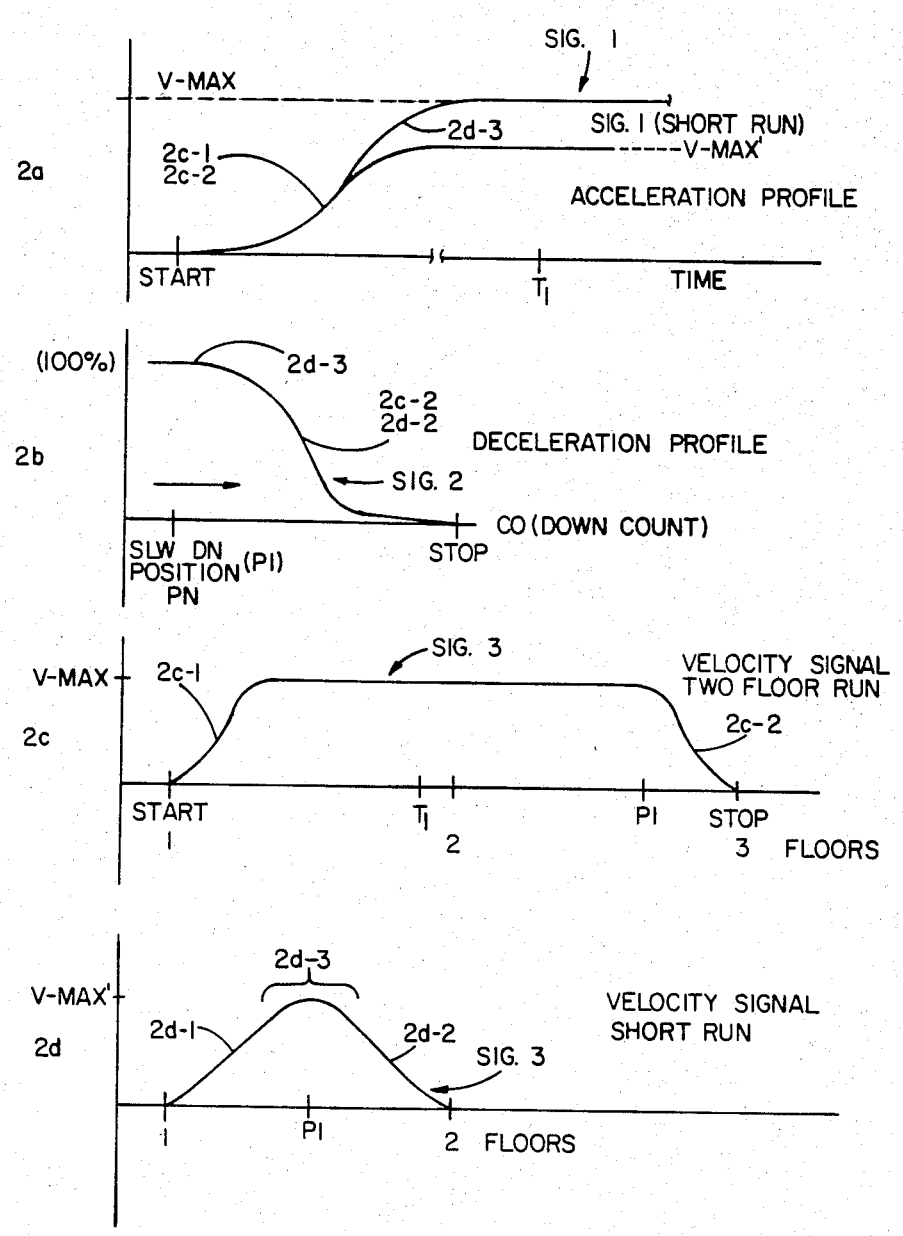
FIG. 2 contains graphs showing different velocity signals, waveforms 2*a–d;* 2*a* shows the analog velocity signal v. time; 2*b* the digital cofficient v. distance; 2*c* the velocity signal (the fourth signal) for a normal run (2 floors); and 2*d* a short run (1 floor).

In this system, the JERK signal (the second derivative of velocity) is supplied to an integrator 12 which produces an acceleration signal ACS on the line 12*a,* and that signal is either positive or negative depending on JERK signal polarity. The ACS signal is then supplied to a limiter 14 to limit the maximum acceleration rate by limiting the ACS signal's magnitude to avoid an uncomfortable ride. The ACS signal, on the line 14*a,* is supplied to another integrator 16, which, using the ACS signal, provides a velocity signal SIG. 1 on the line 16*a.* This SIG. 1 signal is applied to a limiter 18 whose purpose, similar to that of the first limiter, is to limit the maximum level of the limiter output signal (SIG. 1), which, in this case, prevents overspeeding. This velocity signal SIG. 1 is shown as waveform 2*a* in FIG. 2, and, there, it can be seen that the SIG. 1 signal (it can be positive or negative depending on direction) gradually increases (due to the integration) to a maximum level V-MAX over time beginning from a start point, which, in this instance, is when, to move the car from a floor, the JERK signal is first applied. Waveform 2*a* also shows a signal, SIG. 1 (Short run), this the SIG. 1 signal produced at position P1 on a short run by opening a switch SW, between limiter 14 and integrator 16, when the bar reaches position P1. The result is a lower final velocity V MAX! The SIG. 1 signal is supplied to a multiplying circuit 20, the output of which, on the line 20*a,* is a signal SIG. 3, the VELOCITY SIGNAL. This bipolar analog signal is applied to the motor controls to control motor speed and direction. The SIG. 3 signal is shown in waveforms 2*c* and 2*d* in FIG. 2. Waveform 2*c* is the SIG. 3 signal for a two-floor (or more) run, while waveform 2*d* shows the SIG. 3 signal for a short run, and the differences are important to observe. In waveform 2*c* the car starts at a floor 1, accelerates, range 2*c*-1, to a maximum velocity (reached at time T1) and then is gradually decelerated, range 2*c*-2, to a stop at floor 3. In waveform 2*d*, on the other hand, the car accelerates, range 2*d*-1, but before the SIG. 1 signal reaches maximum velocity (at about T1 is waveform 2*d*), the car starts to decelerate, range 2*d*-2. The SIG. 1 signal, it needs to be remembered, only defines acceleration, the change in velocity from start to some maximum velocity (reached at time T1); that it defines the profiles for ranges 2*c*-1 and 2*d*-1. But, the deceleration profile from the maximum velocity is determined by the magnitude of the SIG. 2 signal, and it varies from unity (100%) to zero, and, according to the invention, is digitally generated, not as a function of time, but distance—the distance to the floor.

Because the SIG. 3 signal is the product of the signals SIG. 1 and SIG. 2, the velocity of the car follows the SIG. 1 profile when the SIG. 2 signal is at a magnitude of unity. But, as SIG. 2 decreases to zero from unity, the magnitude of that product decreases. When the SIG. 1 signal is constant, it follows the SIG. 2 signal's profile. If not (below T1), it is a blend of the two (range 2*d*-3 on a short run).

The SIG. 2 signal is the analog equivalent of a digital coefficient that reflects, for selected positions from the slowdown point, a percentage (from 100 to 0) of maximum velocity, in other words, the slowdown profile. This digital coefficient is generated through the use of a position transducer PT which is connected to the car and which, as shown in FIG. 1, produces a signal SIG. 4 comprising a succession of X pulses, the repetition rate of which is proportional to car speed. The SIG. 4 signal is supplied to a switch 24 which is controlled by the SLW-DN signal. As the car approaches the floor, it reaches a position P1, a preselected distance from the floor, where the SLW-DN signal is generated. This actuates the switch 24 which connects the SIG. 4 signal, the output from the position transducer, to a digital counter 28. This counter counts down in response to the SIG. 4 signal from a preset number (PN), and the counter is reset to that present number each time the car is started on a run to a floor. The counter output signal (CO), a down count representing PN-X, is applied to an addressable memory (ROM) 30. The CO signal is an address to a particular binary number DC stored in the memory. That binary number DC is the digital equivalent of the analog SIG. 2, and is outputted in response to the CO signal. The binary number DC represents a desired percentage of maximum car velocity for the particular location associated with the CO signal and is applied to a D-A converter 32 which, in response, produces the SIG. 2 signal. Use of a digitally-generated distance, but not time dependent deceleration coefficient is the main reason for the smooth changing range 2*d*-3 from acceleration to deceleration on the short run, waveform 2*d*.

The relationship between the SIG. 2 signal and car-floor distance, obviously, is completely arbitrary. The relationship depends upon the correlation between the stored coefficients (the DC output) in the memory and the down count (the CO signal). It is possible, of course, to use more than one memory, for example, perhaps to select a pattern for different operating modes by selecting a memory with a different correlation between the CO signal and DC output. In other words, by simply selecting a different memory, wherein the relationship between the stored coefficients and car position as manifested by the digital counter are different, different deceleration profiles can be selected.

Using the foregoing description, one skilled in the art may make other modifications, variations, and alterations in the invention, in addition to those which have been described, without departing from the true scope and spirit of the invention embodied therein.

We claim:

1. An elevator having a car, a motor, a motor speed control and a car velocity profile generator, characterized in that the car velocity profile generator comprises:
   a. a car position sensor that provides a first signal representing change in car position during car motion;
   b. means for providing a first analog signal whose magnitude varies at a preselected time rate, said means providing said first analog signal in order to increase motor speed;
   c. means responsive to the first signal from the position sensor for providing a digital signal, starting at an approach position to a floor, that represents the desired velocity according to a stored velocity profile, said digital signal having a maximum of unity in response to the initial application of the first signal and decreasing from unity in response to the change in car position represented by the change in the first signal as the car approaches the floor;
   d. means for converting the digital signal into an analog equivalent;
   e. means for providing a third analog signal which is the product of the first and second analog signals, so that the magnitude of the third analog signal decreases in proportion to the change in magnitude from unity of the first digital signal as the car approaches a floor, said third analog signal being provided to the motor speed control to control motor speed in proportion to the magnitude of said third analog signal.

2. An elevator according to claim 1, characterized in that:

said means responsive to the first signal comprises a counter for counting back from a predetermined binary count to provide a counter output signal that indicates change in car position from the time of application of the first signal and a memory for storing number coefficients between one and zero on a slowdown profile curve and providing one number coefficient in response to a counter output signal addressing the coefficient to provide said digital signal.

3. An elevator according to claim 2 characterized in that:

said means responsive to the first signal comprises a switch for connecting the the first signal to the counter when the car reaches the approach position, said counter providing at that time an outpout that produces from said memory a coefficient with a magnitude equivalent to unity.

* * * * *

UNITED STATES PATENT AND TRADEMARK OFFICE

CERTIFICATE OF CORRECTION

PATENT NO. : 4,527,662

DATED : July 9, 1985

INVENTOR(S) : John C. Doane; Clement A. Skalski

It is certified that error appears in the above-identified patent and that said Letters Patent is hereby corrected as shown below:

Col. 1, line 16, "vaciations" should read --variations--.

Col. 2, line 65, "bar" should read --car--.

Col. 3, line 12, "is" should read --in--.

Col. 3, line 48, "present" should read --preset--.

Col. 4, line 64, "outpout" should read --output--.

Signed and Sealed this

*Fifteenth* Day of *October 1985*

[SEAL]

*Attest:*

*Attesting Officer*

DONALD J. QUIGG

*Commissioner of Patents and Trademarks—Designate*